US010260737B2

(12) United States Patent
McGuire

(10) Patent No.: US 10,260,737 B2
(45) Date of Patent: Apr. 16, 2019

(54) DECORATIVE LIGHT RETAINING GUTTER

(71) Applicant: Michael McGuire, Howell, MI (US)

(72) Inventor: Michael McGuire, Howell, MI (US)

( * ) Notice: Subject to any disclaimer, the term of this patent is extended or adjusted under 35 U.S.C. 154(b) by 0 days.

(21) Appl. No.: 15/895,444

(22) Filed: Feb. 13, 2018

(65) Prior Publication Data

US 2018/0231233 A1 Aug. 16, 2018

Related U.S. Application Data

(60) Provisional application No. 62/458,863, filed on Feb. 14, 2017.

(51) Int. Cl.

| | |
|---|---|
| ***F21V 33/00*** | (2006.01) |
| ***F21V 19/00*** | (2006.01) |
| ***F21S 4/10*** | (2016.01) |
| ***E04D 13/064*** | (2006.01) |
| ***F21V 23/04*** | (2006.01) |
| *F21W 121/00* | (2006.01) |

(52) U.S. Cl.

CPC ..... *F21V 33/006* (2013.01); *E04D 13/064* (2013.01); *F21S 4/10* (2016.01); *F21V 23/0435* (2013.01); *F21V 19/0015* (2013.01); *F21W 2121/004* (2013.01)

(58) Field of Classification Search

CPC . E04D 13/064–13/0727; A01G 9/1476; F21V 33/006; F21S 4/20

See application file for complete search history.

(56) References Cited

U.S. PATENT DOCUMENTS

| | | | | |
|---|---|---|---|---|
| 3,204,090 | A * | 8/1965 | Kvarda, Jr. | F21S 4/20 362/249.01 |
| 5,311,414 | A | 5/1994 | Branham | |
| 6,363,662 | B1 * | 4/2002 | Coates | E04D 13/076 362/147 |
| 6,652,112 | B1 * | 11/2003 | Lucarelli | F21V 21/08 362/145 |
| 6,955,458 | B2 * | 10/2005 | Cheema | F21V 33/006 362/145 |
| 7,344,265 | B1 * | 3/2008 | Tieken | E04D 13/064 362/145 |
| 7,908,792 | B2 | 3/2011 | Heighton | |
| 2004/0105255 | A1 * | 6/2004 | Seeburger | E04D 13/158 362/145 |
| 2011/0090676 | A1 * | 4/2011 | Sortor | F21V 17/16 362/145 |
| 2014/0022767 | A1 | 1/2014 | Martinez | |
| 2016/0047516 | A1 * | 2/2016 | Taylor | F21S 8/036 362/368 |

FOREIGN PATENT DOCUMENTS

| | | | |
|---|---|---|---|
| JP | 2007092277 A | * | 4/2007 |
| JP | 2008202367 A | * | 9/2008 |

* cited by examiner

*Primary Examiner* — Mariceli Santiago
(74) *Attorney, Agent, or Firm* — Global Intellectual Property Agency, LLC; Daniel Boudwin

(57) ABSTRACT

A device for protecting and retaining a decorative light strand. A gutter has a first channel and a second channel. The second channel is formed at a top edge of a front wall of the first channel. The second channel is inverted relative to the first channel. An outer vertical sidewall of the second channel has a plurality of apertures disposed therein. The second channel is configured to house the strand of a decorative light strand and each aperture is configured to frictionally secure a light bulb of the decorative light strand therein.

5 Claims, 3 Drawing Sheets

DECORATIVE LIGHT RETAINING GUTTER

CROSS REFERENCE TO RELATED APPLICATIONS

This application claims the benefit of U.S. Provisional Application No. 62/458,863 filed on Feb. 14, 2017. The above identified patent application is herein incorporated by reference in its entirety to provide continuity of disclosure.

BACKGROUND OF THE INVENTION

The present invention relates to gutters and lights supports. Specifically, the present invention provides a gutter with a second channel to house string lights.

Decorating the exterior of a dwelling with string lights is a classic winter holiday tradition. These string lights are often hung from the gutters of the dwelling to outline the dwelling with light. Unfortunately, these lights must be taken down a month or two after they are hung. That processes usually involves a dwelling owner traversing up and down an unstable ladder while carrying a handful of string lights. Therefore, a need exists for a gutter having a means to retain and protect decorative string lights year around.

Several devices have been proposed to retain and protect string lights on the exterior of a dwelling. One such device teaches an elongated housing having apertures, wherein the elongated housing has a light strip disposed therein. Another device teaches a rain gutter illumination system disposed within an interior oriented flange. These devices, however, fail to disclose a gutter having a second inverted channel having apertures disposed in an outer vertical sidewall of the second channel.

SUMMARY OF THE INVENTION

In view of the foregoing disadvantages inherent in the known types of decorative light retaining gutters now present in the prior art, the present invention provides a string light supportive gutter wherein the same can be utilized for providing convenience for the user when decorating a home with lights. The present system comprises a first channel and a second channel. A front wall of the first channel separates the first and second channel, wherein the second channel is on an opposite side of the front wall as the first channel. The second channel is formed at a top edge of the first wall and is inverted relative to the first channel. A plurality of apertures is disposed in an outer vertical sidewall of the second channel, wherein each aperture is configured to frictionally secure a light bulb of a string of lights therein.

One object of the present invention is to provide a string light supportive gutter that has a second channel that houses and protects a string of decorative lights while allowing the lights to be displayed out of apertures in an outer wall of the second channel.

Another object of the present invention is to provide a decorative light retaining gutter having a second channel that is inverted relative to a first channel, wherein the second channel is formed on a flange of the first channel.

Yet a further object of the present invention is to provide a decorative light retaining gutter, wherein the lights retained therein can be controlled remotely by a mobile device.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
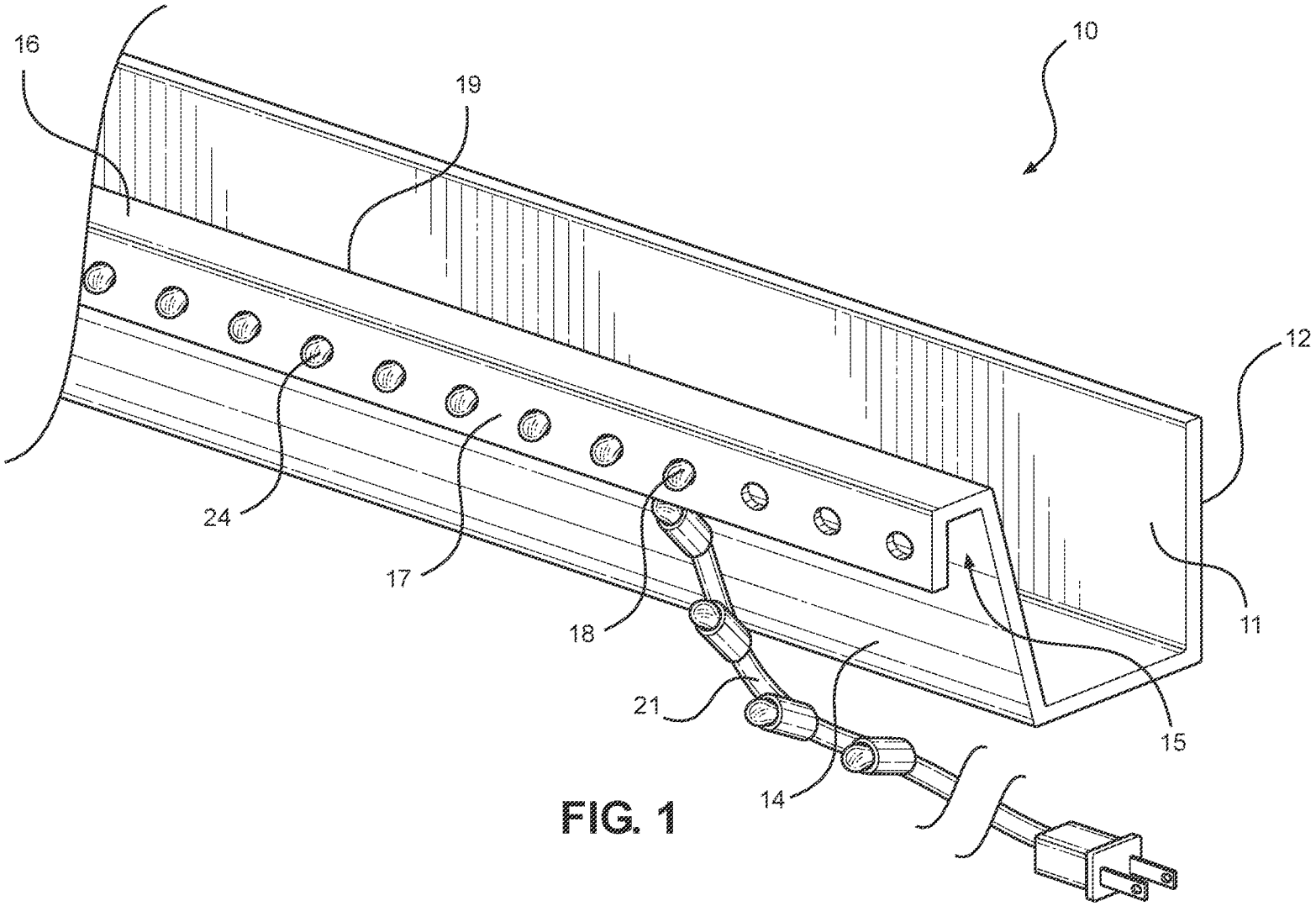
FIG. 1 shows a perspective view of an embodiment of the decorative light retaining gutter.

Reference is made herein to the attached drawings. Like reference numerals are used throughout the drawings to depict like or similar elements of the decorative light retaining gutter. The figures are intended for representative purposes only and should not be considered to be limiting in any respect. Unless specifically limited to a single unit, "a" is intended to be equivalent to "one or more" throughout the present disclosure.

Referring now to FIG. 1, there is shown a perspective view of an embodiment of the decorative light retaining gutter. The decorative light retaining gutter 10 comprises a first channel 11 having a front wall 14. The first channel 11 is a typical gutter channel that collects rain runoff from a roof and directs the runoff toward a drain. The first channel 11 is formed between a back wall 12, which connects to a roof or side of a house, and the front wall 14.

A second channel 15 is formed at a top edge 19 of the front wall 14. The second channel 15 is formed on an opposite side of the front wall 14 as the first channel 11, i.e. the second channel 15 is formed exterior to the first channel 11. Additionally, the second channel 15 is inverted relative to the first channel 11. In the illustrated embodiment, the first channel 11 opens in an upward direction, whereas the second channel 15 opens in a downward direction.

In the illustrated embodiment, the second channel 15 is formed between an outer vertical sidewall 17 and the front wall 14 of the first channel 11. An elongated horizontal shelf 16 is disposed between the front wall 14 and the outer vertical sidewall 17, wherein the outer vertical sidewall 17 extends perpendicularly downward from the elongated horizontal shelf 16 and the elongated horizontal shelf 16 extends outward from the top edge 19 of the front wall 14.

A plurality of apertures 18 is disposed in the outer vertical sidewall 17 of the second channel 15. In the illustrated embodiment, the apertures 18 are disposed in a linear arrangement and are equidistant from each other. The apertures 18 are configured to frictionally secure a light 24, i.e. a bulb, in a string or strand of decorative lights therein. In use, the string 21 of the string lights will be sequestered within the second channel 15 and secured in that position by each light 24 of the strand 21 being secured within an aperture 18. In one embodiment, the lights 24 are LED lights. In some embodiments, the wavelength of light emitted from the lights 24 can selectively change, allowing the same lights 24 to be used for varying seasonal holidays or events.

Figure 2:
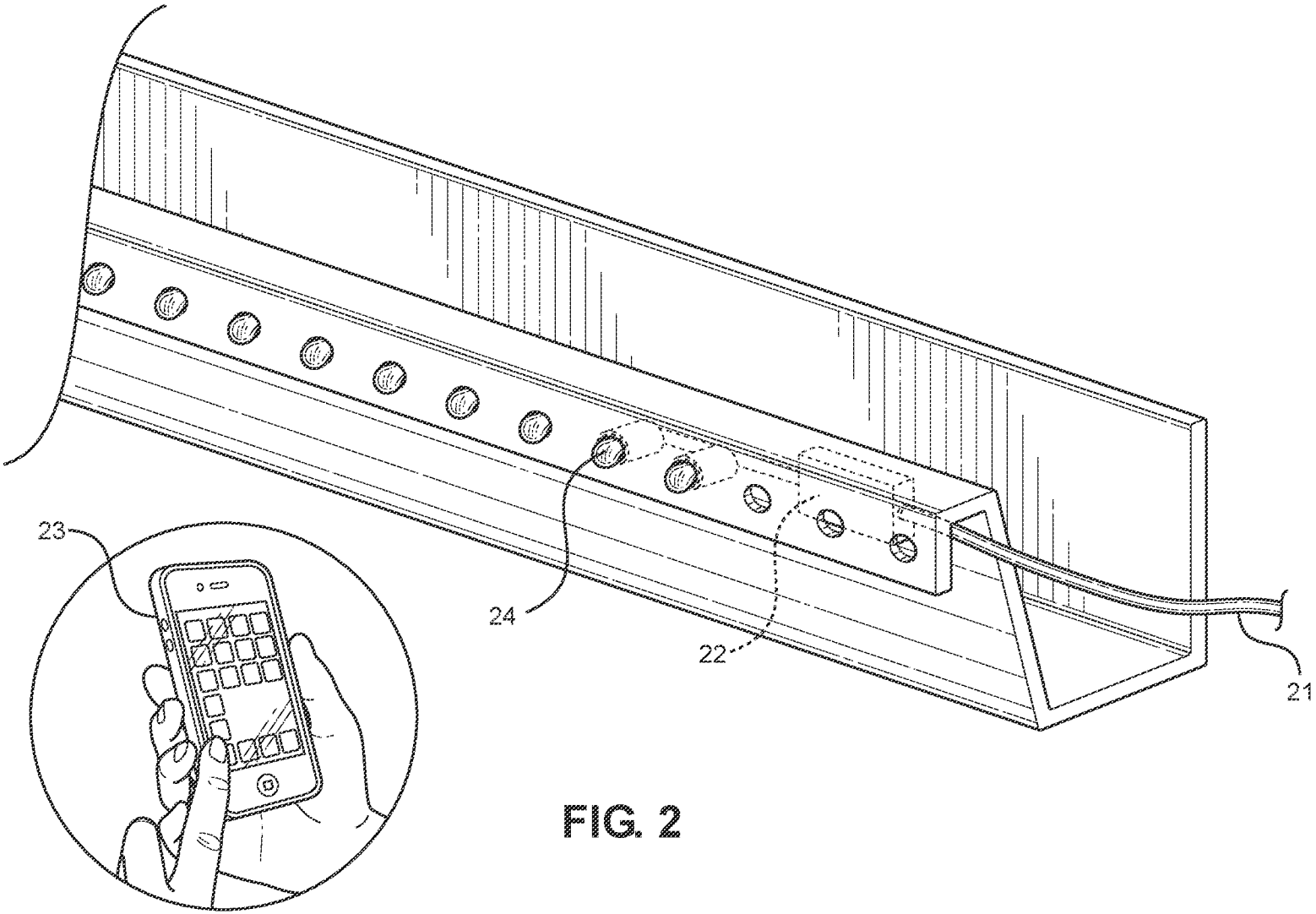
FIG. 2 shows a perspective view of an alternate embodiment of the decorative light retaining gutter.

Now referring to FIG. 2, there is shown a perspective view of an alternate embodiment of the decorative light retaining gutter. In this illustrated embodiment, a control switch 22 is operably connected to the lights 24. The control switch 22, when actuated, selectively turns on or off the lights 24. Further, in some embodiments, the control switch 22 is in wireless communication with a mobile device 23, whereby a user can selectively actuate the control switch 22 via the mobile device. In embodiments where the lights 24 can alternate colors, the control switch 22 is configured to also selectively control the color of the lights 24.

Figure 3:
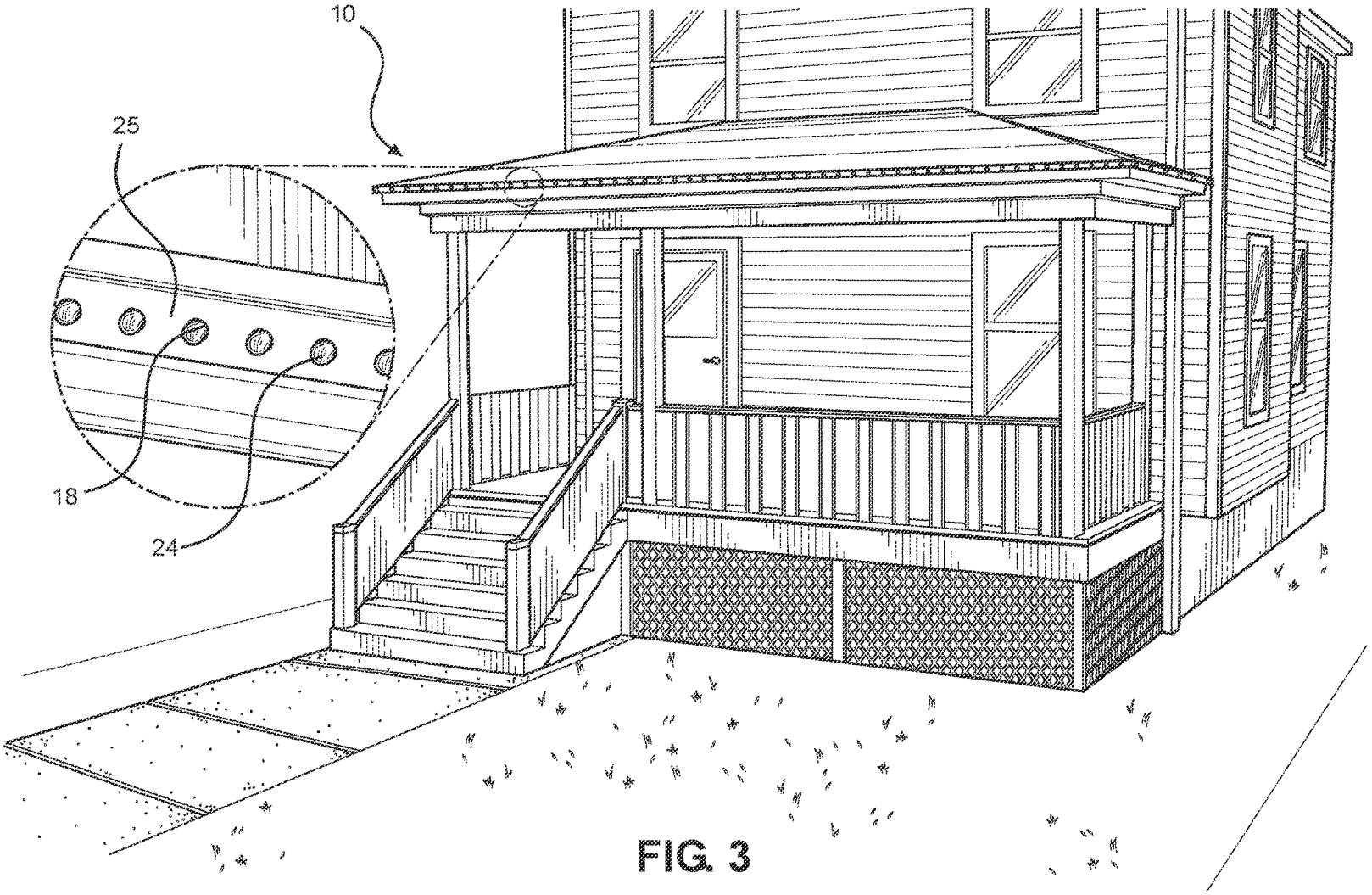
FIG. 3 shows a perspective view of an embodiment of the decorative light retaining gutter in use.

Referring now to FIG. 3, there is shown a perspective view of an embodiment of the decorative light retaining gutter in use. As seen in this figure, once inserted into the apertures 18, the lights 24 protrude outward from the apertures 18, as to be visible to a viewer looking at the decorative light retaining gutter 10. Since the decorative light retaining gutter 10 shelters a decorative light strand 25 sequestered therein, a user may choose to leave the decorative light strand 15 within the decorative light retaining gutter 10 throughout the year with the assurance that damage to the decorative light strand 25 will be mitigated.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative light retaining gutter, comprising:

a first channel, formed by a front wall, a bottom wall, and a back wall;

a second channel, formed by an elongated horizontal shelf that extends forward from a top edge of the front wall, and an outer vertical sidewall that extends downward from the elongated horizontal shelf;

wherein the outer vertical side wall includes a plurality of apertures, wherein each aperture of the plurality of apertures is configured to removably house a light bulb of a string light;

wherein the outer vertical sidewall is shorter than the front wall.

2. The decorative light retaining gutter of claim 1, wherein the outer vertical sidewall of the second channel extends perpendicularly downward from a forward edge of the elongated horizontal shelf of the second channel.

3. The decorative light retaining gutter of claim 1, wherein the apertures are spaced equidistantly from each other.

4. The decorative light retaining gutter of claim 1, wherein the second channel houses a control switch, wherein the control switch is operably connected to the string light.

5. The decorative light retaining gutter of claim 4, wherein the control switch is in wireless communication with a mobile device.

* * * * *